US005444872A

United States Patent [19]

Johnson

[11] Patent Number: 5,444,872

[45] Date of Patent: Aug. 29, 1995

[54] OVERLAPPING HOSPITAL GOWN

[76] Inventor: Catherine A. Johnson, 720 Gordon Ter., Suite 11K, Chicago, Ill. 60613

[21] Appl. No.: 279,516

[22] Filed: Jul. 25, 1994

Related U.S. Application Data

[63] Continuation-in-part of Ser. No. 16,571, Dec. 20, 1993.

[51] Int. Cl.[6] ..... A41D 13/00

[52] U.S. Cl. ..... 2/114; 2/69; 2/105; 2/243.1

[58] Field of Search ..... 2/46, 50, 51, 52, 69, 2/69.5, 75, 104, 105, 106, 114, 115, 243.1

[56] References Cited

U.S. PATENT DOCUMENTS

| | | | |
|---|---|---|---|
| 2,818,573 | 1/1958 | O'Donnell | 2/114 |
| 3,078,467 | 2/1963 | Artzt | 2/114 |
| 4,446,575 | 5/1984 | Davis . | |
| 4,578,825 | 4/1986 | Vote | 2/114 |
| 4,622,699 | 11/1986 | Spriggs | 2/144 |
| 4,653,120 | 3/1987 | Leaf . | |
| 4,864,657 | 9/1989 | Lake | 2/114 |

*Primary Examiner*—Jeanette E. Chapman
*Attorney, Agent, or Firm*—Leydig, Voit & Mayer

[57] ABSTRACT

A hospital-type gown wherein comfort, style and cost savings in manufacture are provided, yet still enabling the patient wearer to preserve modesty while providing necessary access to the patient by a doctor or nurse for either examination or treatment wherein the gown is essentially made up for four parts, including two identical sleeve pattern panels and two identical body pattern panels, with the sleeve pattern panels being sewn to respective ones of the body panels along sleeve-body panel seams which extend from the neck hem to under the armpits and the then formed left and right halves are sewn together overlapping one another such that the joinder at the rear extends along the neck and down the sleeve-body seams so that the overlapping portions are about ⅓ the overall width of the gown. The front of the gown has a V neck shape formed and the overlapping frontal portions are on the order of about ⅓ the garment width and provided with a suitable tie to releasably secure the flapped portions at one location.

3 Claims, 4 Drawing Sheets

OVERLAPPING HOSPITAL GOWN

RELATED APPLICATIONS

The present application is a continuation-in-part of applicant's U.S. application Ser. No. 29/016,571, filed Dec. 20, 1993 entitled "Hospital-Type Gown Design."

FIELD OF INVENTION

The present invention relates generally to garments and more particularly to specialty garments such as worn by patients as covering in hospitals, clinics, physician's offices and the like during medical treatment.

BACKGROUND ART

Previously, and in common usage, there have been hospital gowns which have a solid front and a single rear overlapping panel opening extending from the neck to the hem and with at least a couple of ties to secure the rear flaps together. With such gowns, the wearer puts it on in reverse and may require assistance in tying the rear ties. The rear flaps also tend to fly open and do not necessarily provide ample coverage for maintaining a wearer's modesty.

A proposed improvement was made to such typically used gowns as described in Leaf U.S. Pat. No. 4,653,120, issued Mar. 31, 1987 and entitled "Hospital-Type Gown With Front and Rear Openings." The gown of the Leaf patent, as proposed, was to be made up of left and right halves, including arm openings with the two halves being permanently connected together only along the neckline at the back of the gown and thereby providing rear overlaps which could be tied together with one or more ties at the front, and also at least one tie on the back as well. While such a proposed gown purported to solve the problem of preserving a patient's modesty, yet allowing a physician or nurse to manipulate the gown easily for treatment or examination purposes, it has not apparently found widespread acceptance or replacement of the still more commonly utilized front slip on and rear opening type of gowns. The rear overlapping portions of the Leaf patent gown, secured only at the neckline, still provide only a relatively narrow band of overlap even though it is relatively substantial in comparison to the solely rear tied types widely utilized which often fail to provide any real coverage to the patient.

In addition, the Leaf patent construction arrangement still renders such gowns ill fitting and practically shapeless as well as not being readily susceptible to cost savings in material and labor necessary for assembling the gown.

Accordingly, a need has still arisen for a hospital-type gown which can be worn more comfortably and stylishly by a patient, yet overcomes all the problems attendant with prior gowns, particularly in the areas of cost savings and east of manufacture while not diminishing or interfering with the utilitarian aspects required of such gowns.

SUMMARY OF THE INVENTION

In accordance with the present invention, a hospital-type gown is provided wherein in addition to comfort, style and cost savings in manufacture, the gown enables the patient wearer to still preserve modesty while providing necessary access to the patient by a doctor or a nurse for either examination or treatment. To this end, the gown is essentially made up of four parts, including two identical sleeve pattern panels and two identical body pattern panels. The sleeve pattern panels are sewn to respective ones of the body panels along sleeve-body panel seams which extend from the neck hem to under the arm pits and the then formed left and right halves are sewn together overlapping one another such that the joinder at the rear extends along the neck and down the sleeve-body seam such that the overlapping portions are about one-third the overall width of the garment. The front of the gown has a V-neck shape formed and the overlapping portions again on the order of about $\frac{1}{3}$ the garment width are provided with a suitable tie or fasteners to releasably secure the flapped portion at at least one location.

BRIEF DESCRIPTION OF THE DRAWINGS

A more complete understanding of the invention can be had by reference to the following detailed description in conjunction with the accompanying drawings in which.

DETAILED DESCRIPTION

Figure 1:
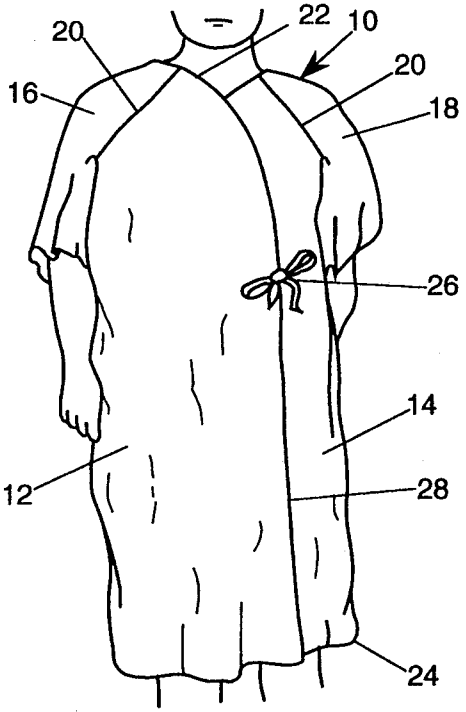
FIG. 1 is a front perspective view of a gown embodying the present invention as worn by a patient.
Figure 4:
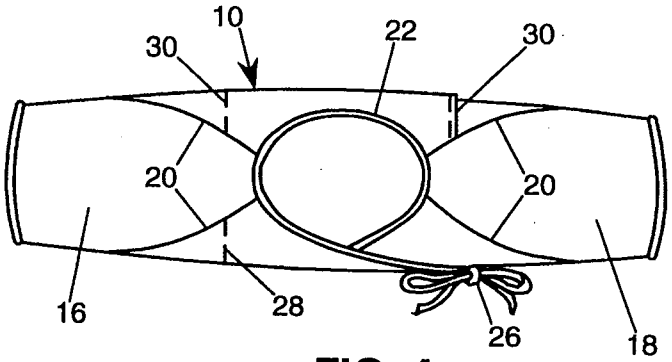
FIG. 4 is a top plan view thereof.
Figure 5:
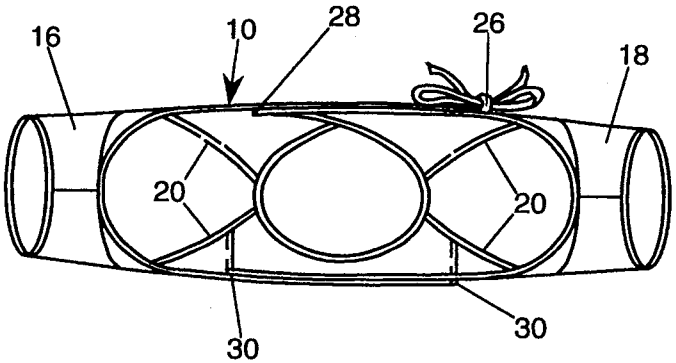
FIG. 5 is a bottom plan view thereof.

Referring now to the drawings, as illustrated in FIG. 1, the gown of the present invention 10 is shown as it would appear on a person. The gown of the present invention may be made of any conventional woven or non-woven fabric, paper or other convenient sheet-form material. Preferably, very light weight cotton flannel may be utilized with a capability of undergoing at least about four washings with fairly high temperature water capable of sterilizing as well as cleaning. The gown 10 is made up of essentially four parts comprising right and left identical body pattern panels 12, 14 and substantially identical sleeve pattern panels 16, 18. The sleeve panels 16, 18 may be sewn to the respective body panels 12, 14 forming a sleeve-body seams 20 that extends from the neckline 22 to the underarm and then the two body panels 12, 14 are sewn together overlapping one another from the neckline 22 to the hem 24 at the bottom.

Figure 6:
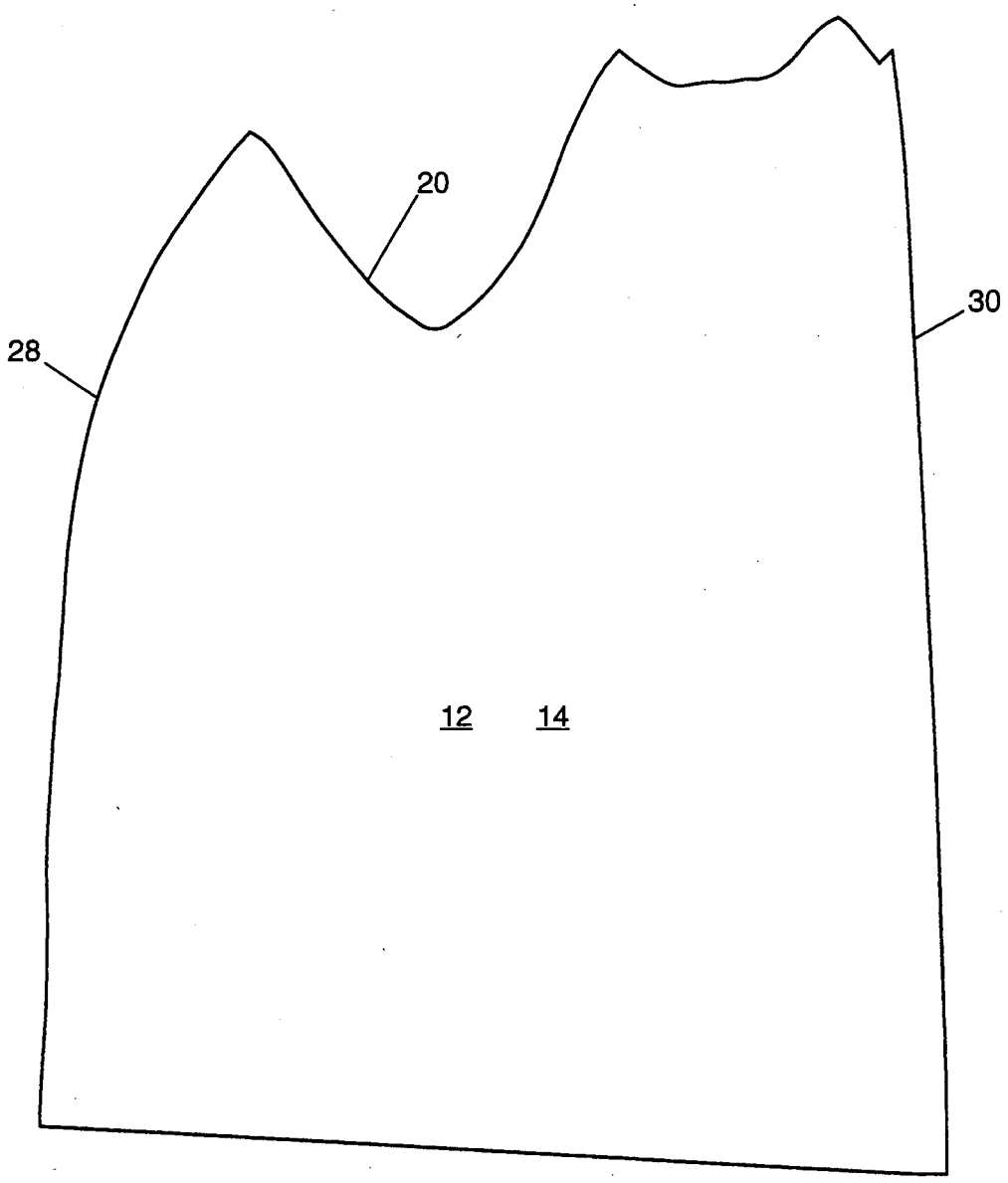
FIG. 6 is a planer view of the pattern for the body panel parts.
Figure 7:
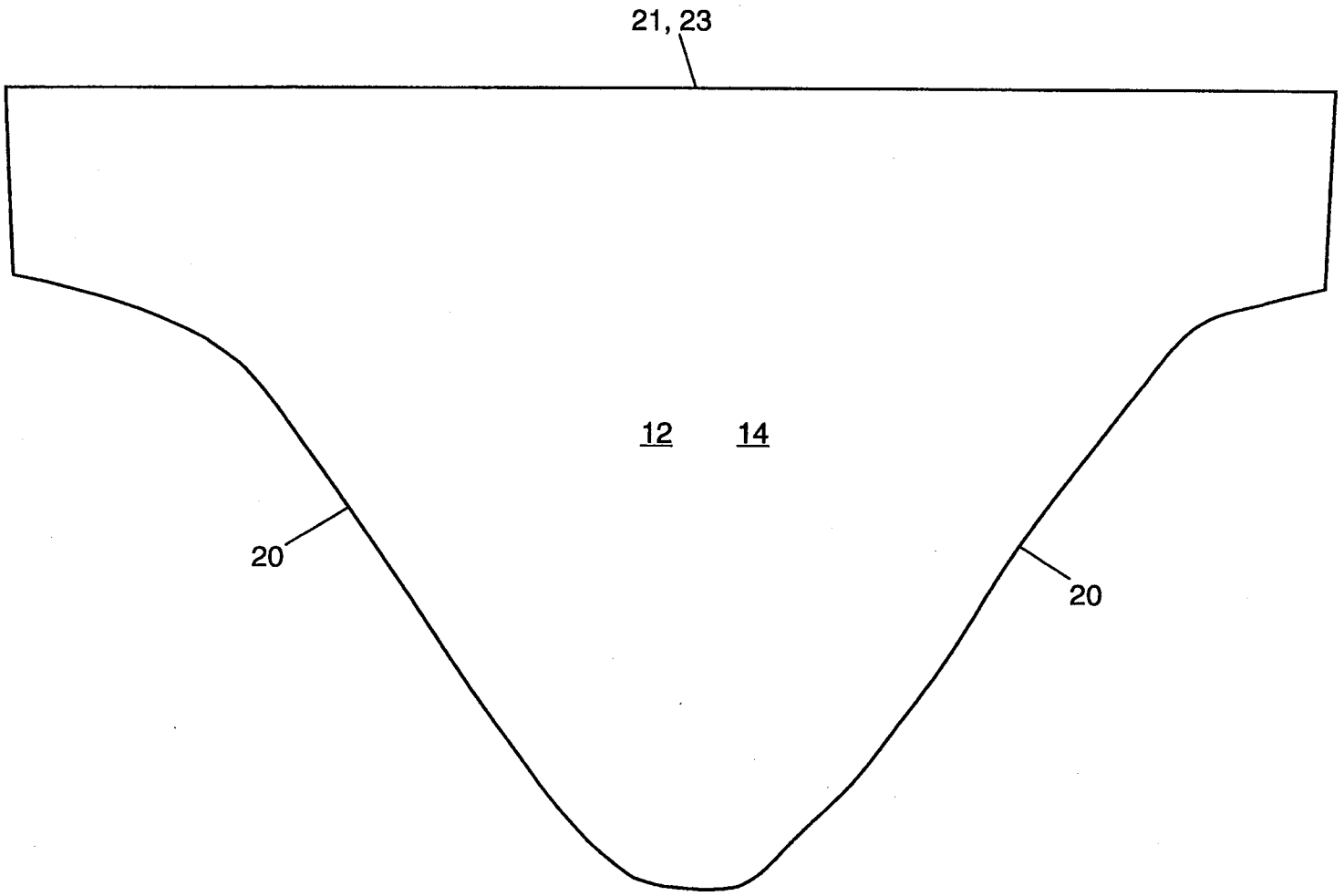
FIG. 7 is a pattern view of the sleeve panel parts.

The sleeve outer ends may be finished with fold over seams 22, 23. Securement of the body panels 12, 14 extends around the neckline and along and down the sleeve-body panel seams 20 on both sides of the gown. This securement line is shown by the double-width line 20*a* in FIG. 3. The arrangement is such that the overlaps at the rear, as well as at the front, extend more than about $\frac{1}{3}$ of the overall width of the gown. As compared to the Leaf patent arrangement, wherein the right and left halves being permanently connected only along the neckline at the back of the gown with an overlap of on the order of four to seven inches, the present gown has an overlap due to the pattern formation and securement that does extend on both sides along the sleeve securement seams 20 such that the width of the overlap is considerably greater than that of the relatively narrow overlap of the Leaf patent construction. Indeed, the overlap of the panels referenced by edges 28 in FIG. 2 and edges 30 in FIG. 3, respectively, are such that at the rear of the present gown construction it is not necessary to provide a tie, yet the overlapping portions may be separated readily for examination or treatment purposes. As may be seen by reference to FIGS. 6 and 7, the body panels 12, 14 and sleeve panels 16, 18 have respectively identical patterns. If there is a print side to the fabric, the patterns would have a left and right panel. For example, a gown having a width on the order of 24–36 inches would have overlapping panel portions on the order of about 9–12 inches.

Figure 2:
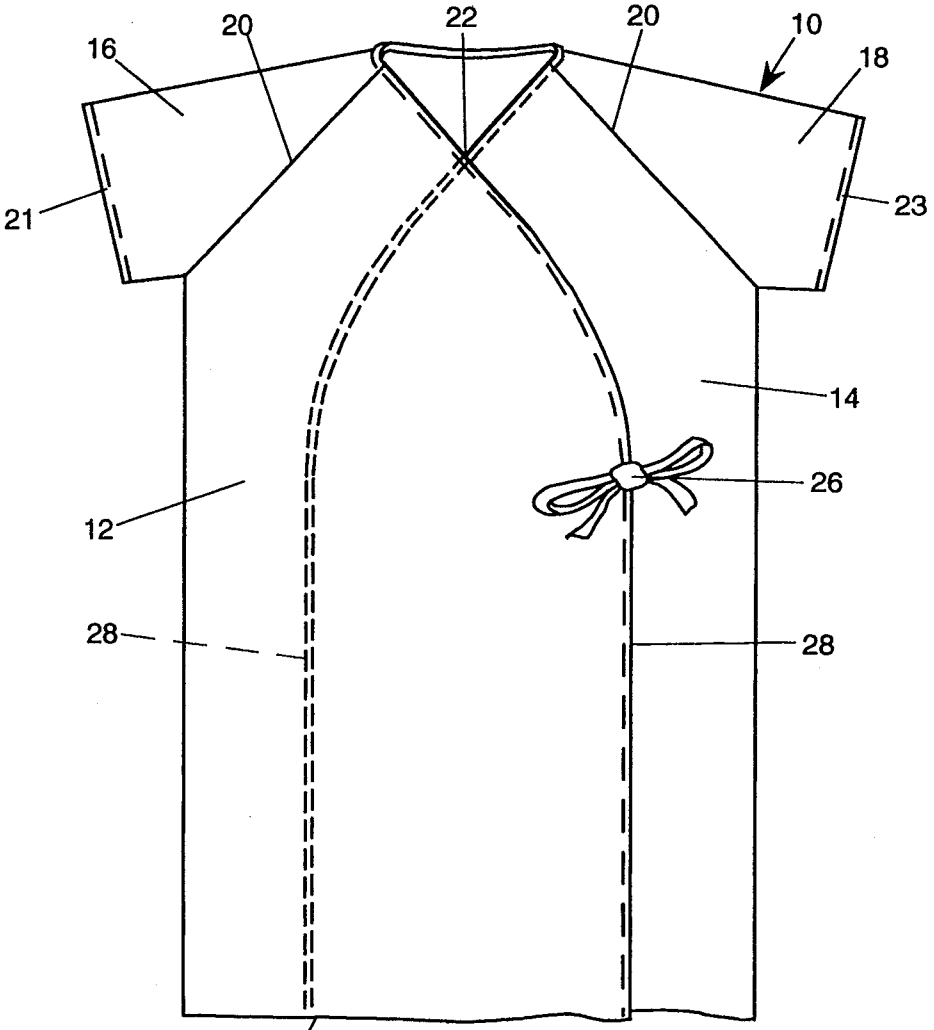
FIG. 2 is a front elevational view of the gown of the present invention.
Figure 3:
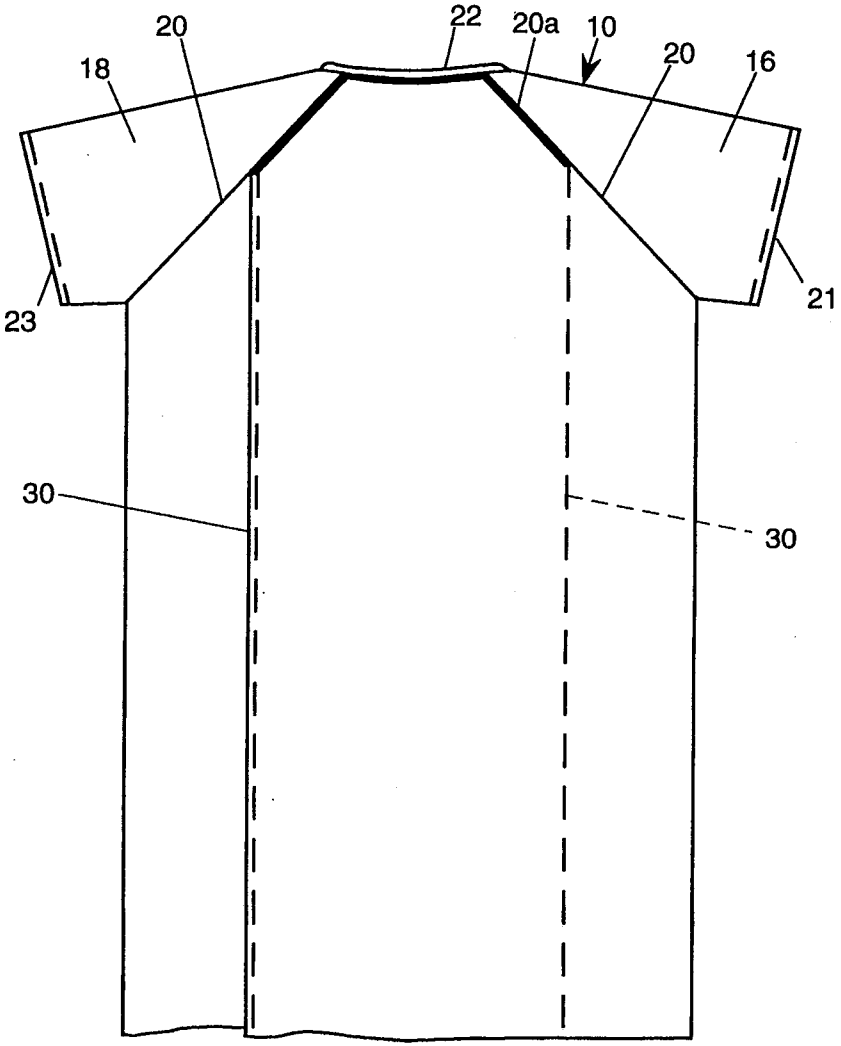
FIG. 3 is a rear elevational view thereof.

The body panel pattern portions at the front are shaped to provide a V neckline and overlap again by a considerable amount similar to the rear and with one tie 26 being ample for securement. The placement of the tie 26 positioned as shown in FIGS. 1 and 2 holds the front panels together for ease of mobility of the wearer and sufficient coverup for maintaining the wearer's modesty.

The particular placement and orientation of the sleeve-body seams 20 and panel securements also provides a gown with somewhat more style and comfort to the wearer so that it is not an embarrassment to be seen in by others. The construction arrangement of the present gown also makes very efficient use of material, minimizing waste and thereby reducing or minimizing the costs of manufacturing.

I claim:

1. A hospital-type gown comprising, a pair of substantially identical sleeve pattern panels and a pair of substantially identical body pattern panels each of the body pattern panels including a hemmed neck portion, each of said sleeve panels being affixed to respective ones of the body panels along a sleeve-body panel seam which extends at least along a rear side of the respective body panel from the neck hem angularly to under the arm pit to thereby form first and second gown halves, said gown halves being disposed so as to have a substantial overlap forming front and rear overlapping portions and overlapping necklines and being connected together by a securement running along the overlapping portions of the respective rear necklines disposed between the rear sleeve-body panel seams and continuing from the overlapping necklines down and along each of the rear sleeve-body panel seams to secure a portion of each gown half to the sleeve-body panel seam of the other gown half, the rear overlapping portions being about $\frac{1}{3}$ the overall width of the gown, and releasable fastener means connecting the frontal overlapping body panels together, the overlapping frontal portions being about $\frac{1}{3}$ the overall width of the gown.

2. A hospital gown as claimed in claim 1 wherein the neck hem has a V-shape at the frontal portion.

3. A hospital gown as claimed in claim 1 wherein said releasable fastening means is a tie.

* * * * *